US008626005B2

(12) United States Patent
Hiraike

(10) Patent No.: US 8,626,005 B2
(45) Date of Patent: Jan. 7, 2014

(54) PRINTING APPARATUS, AND CONTROL METHOD AND STORAGE MEDIUM THEREFOR

(75) Inventor: Kou Hiraike, Yokohama (JP)

(73) Assignee: Canon Kabushiki Kaisha (JP)

( * ) Notice: Subject to any disclaimer, the term of this patent is extended or adjusted under 35 U.S.C. 154(b) by 397 days.

(21) Appl. No.: 12/892,558

(22) Filed: Sep. 28, 2010

(65) Prior Publication Data

US 2011/0076036 A1 Mar. 31, 2011

(30) Foreign Application Priority Data

Sep. 28, 2009 (JP) ..... 2009-222322

(51) Int. Cl.
*G03G 15/08* (2006.01)

(52) U.S. Cl.
USPC ..... 399/27

(58) Field of Classification Search
USPC ..... 399/9, 24–30, 111; 358/1.9
See application file for complete search history.

(56) References Cited

U.S. PATENT DOCUMENTS

| | | | | |
|---|---|---|---|---|
| 8,135,291 | B2 * | 3/2012 | Chihara | 399/24 |
| 8,270,027 | B2 * | 9/2012 | Ban | 358/1.9 |
| 2003/0012576 | A1 * | 1/2003 | Owen et al. | 399/27 |
| 2006/0280513 | A1 * | 12/2006 | Hatakeyama | 399/27 |

FOREIGN PATENT DOCUMENTS

| | | | |
|---|---|---|---|
| CN | 1831670 | A | 9/2006 |
| CN | 1847994 | A | 10/2006 |
| JP | 2007-128044 | A | 5/2007 |

OTHER PUBLICATIONS

Chinese Office Action for Corresponding CN 201010502218.9, dated Jan. 14, 2013. English translation provided.

* cited by examiner

*Primary Examiner* — Hoan Tran
(74) *Attorney, Agent, or Firm* — Rossi, Kimms & McDowell LLP

(57) ABSTRACT

A printing apparatus capable of reducing the frequency of detection of a recording agent remaining amount and obtaining accurate information of the recording agent remaining amount. When a printed sheet is discharged, a CPU of a printer updates information representing the number of discharged sheets and stores the information into a memory of a print engine. The CPU refers to toner remaining amount information stored in a memory of a cartridge and determines whether there is a sufficient toner remaining amount in the cartridge. If there is no sufficient toner remaining amount, toner remaining amount detection is executed each time printing of one page has been performed. If there is a sufficient toner remaining amount, the toner remaining amount detection is executed when the number of discharged sheets coincides with a predetermined value.

9 Claims, 5 Drawing Sheets

PRINTING APPARATUS, AND CONTROL METHOD AND STORAGE MEDIUM THEREFOR

BACKGROUND OF THE INVENTION

1. Field of the Invention

The present invention relates to a printing apparatus, and a control method and a storage medium therefor.

2. Description of the Related Art

Heretofore, there are known printing apparatuses such as electrophotographic printers (e.g., laser beam printer, LED printer, etc.) and electrophotographic copying machines. The electrographic printing apparatuses are each configured to irradiate light onto a photosensitive member according to image information to form a latent image thereon, supply a recording agent (e.g., toner) to the latent image from a developing device to visualize the image, and transfer the image from the photosensitive member to a recording sheet to form the image onto the recording sheet. With the progress of printing, the toner in a toner container coupled to the developing device is consumed.

The toner container, the developing device, the photosensitive member, a charging device, etc., are generally unified into a cartridge, which can be easily detachably mounted to the printing apparatus. When the toner in the toner container is exhausted, the toner container cartridge is replaced by a user.

Some cartridge has a nonvolatile memory that stores information of, e.g., recording agent such as toner, and a serial number for recognition of individual cartridge.

In the meantime, a toner remaining amount is detected in the printing apparatus to display the toner remaining amount on an operation unit and to stop printing when the toner remaining amount is exhausted. However, the toner remaining amount detection requires a time period of several tens seconds to several minutes. In addition, the toner remaining amount detection cannot be frequently performed in the case of printing apparatus where the developing device, photosensitive member, and toner are consumed by the toner remaining amount detection.

Thus, there is known a method for utilizing recording agent information backed up in a nonvolatile memory of the printing apparatus during a time period from when electric power is turned on to when recording agent information is decided (see, for example, Japanese Laid-open Patent Publication No. 2007-128044).

Another method is known in which toner remaining amount is detected when a predetermined number of sheets from several tens to several hundreds have been printed, toner remaining amount information is stored in a memory of a cartridge, and the stored information is referred to during a period when the toner remaining amount detection is not performed.

However, with the method disclosed in Japanese Laid-open Patent Publication No. 2007-128044, even if the cartridge is replaced, the recording agent information backed up in the nonvolatile memory still represents the recording agent information of the old cartridge before replacement, and therefore recording agent information of a new cartridge cannot be utilized.

With the method that stores toner remaining amount information in the memory of the cartridge, the frequency of execution of toner remaining amount detection is low, and therefore the remaining amount information stored in the memory is sometimes old and lacks reliability. If the toner remaining amount detection is not performed upon replenishment of toner, a problem is posed that it takes a long time until the toner remaining amount is detected.

SUMMARY OF THE INVENTION

The present invention provides a printing apparatus and a control method and a storage medium therefor, which are capable of reducing the frequency of detection of a recording agent remaining amount and obtaining an accurate information of recording agent remaining amount.

According to a first aspect of this invention, there is provided a printing apparatus, which comprises a printing unit configured to perform printing using a recording agent, a detection unit configured to detect a remaining amount of the recording agent, and a control unit configured to control the detection unit to detect the remaining amount of the recording agent each time a first number of pages has been printed by the printing unit in a case where the remaining amount of the recording agent detected by the detection unit is greater than a predetermined value, and configured to control the detection unit to detect the remaining amount of the recording agent each time a second number of pages less than the first number of pages has been printed by the printing unit in a case where the remaining amount of the recording agent detected by the detection unit is less than the predetermined value.

According to a second aspect of this invention, there is provided a control method for a printing apparatus having a printing unit that performs printing using a recording agent and a detection unit that detects a remaining amount of the recording agent, which comprises the steps of controlling the detection unit to detect the remaining amount of the recording agent each time a first number of pages has been printed by the printing unit in a case where the remaining amount of the recording agent detected by the detection unit is greater than a predetermined value, and controlling the detection unit to detect the remaining amount of the recording agent each time a second number of pages less than the first number of pages has been printed by the printing unit in a case where the remaining amount of the recording agent detected by the detection unit is less than the predetermined value.

According to a third aspect of this invention, there is provided a storage medium storing a program for causing a computer to execute the control method according to the second aspect of this invention.

With this invention, the recording agent remaining amount is detected each time printing is executed if it is determined that there is no sufficient recording agent remaining amount, and the recording agent remaining amount is detected at a predetermined frequency if it is determined that there is a sufficient recording agent remaining amount. It is therefore possible to reduce the frequency of detection of the recording agent remaining amount and obtain accurate information of recording agent remaining amount.

Further features of the present invention will become apparent from the following description of exemplary embodiments with reference to the attached drawings.

DETAILED DESCRIPTION OF THE PREFERRED EMBODIMENTS

The present invention will now be described in detail below with reference to the drawings showing preferred embodiments thereof.

(First Embodiment)

Figure 1:
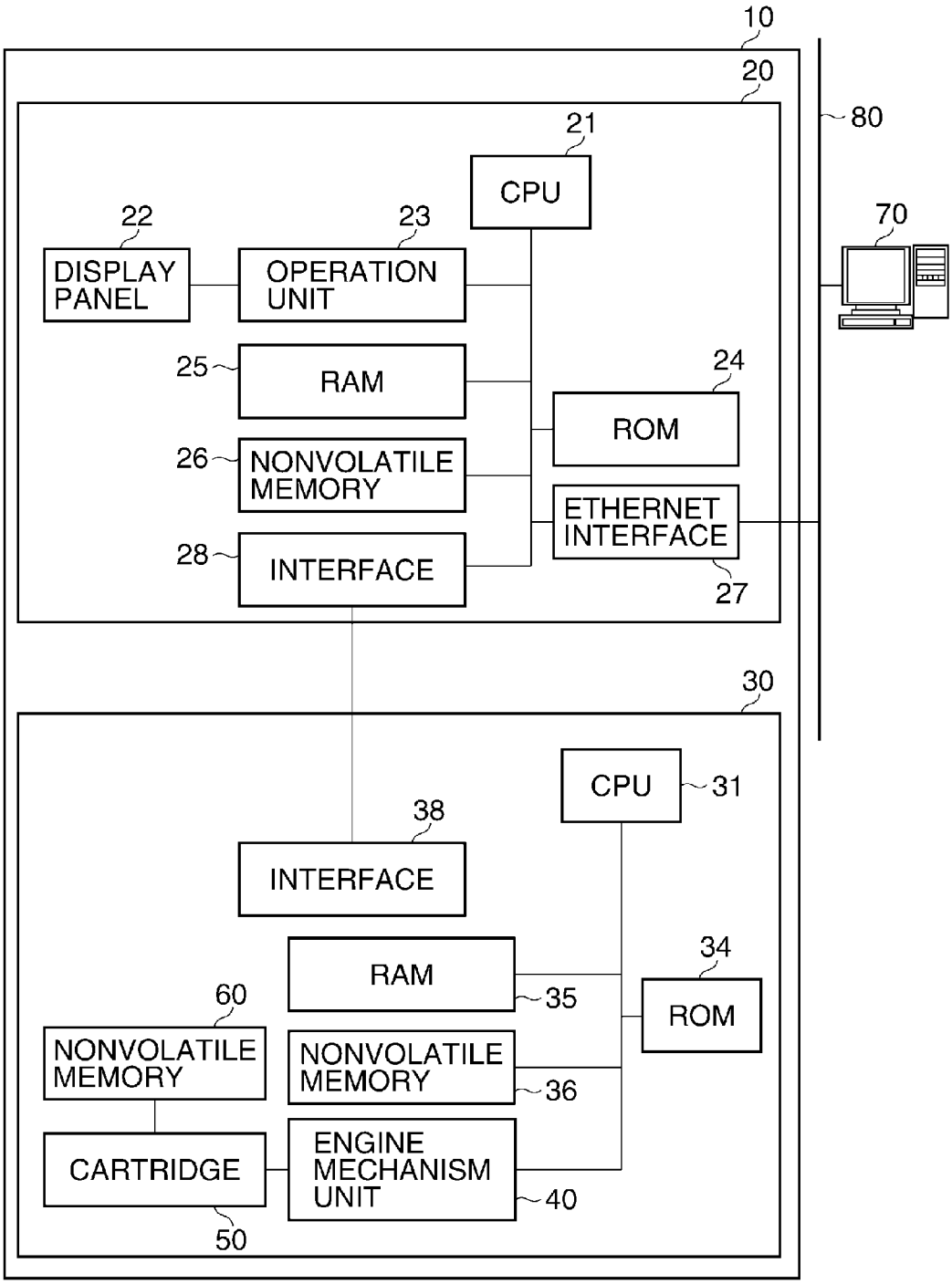
FIG. 1 is a block diagram showing the construction of a printer 10.

FIG. 1 shows in block diagram the construction of a printer 10.

As shown in FIG. 1, the printer 10 as an image forming apparatus includes a controller 20 and a print engine 30, and is connected to a personal computer (PC) 70 via a local area network (LAN) 80.

The controller 20 includes a CPU 21, a display panel 22, an operation unit 23, a ROM 24, a RAM 25, a nonvolatile memory 26, an Ethernet (registered trademark) interface 27, and an interface 28.

The print engine 30 includes a CPU 31, a ROM 34, a RAM 35, a nonvolatile memory 36, an interface 38, an engine mechanism unit 40, a cartridge 50, and a nonvolatile memory 60.

The CPU 21 controls the controller 20. The display panel 22 displays the functions and settings of the printer 10, etc. The operation unit 23 is used to give the printer 10 an operation instruction and program execution instructions.

The ROM 24 stores a program code for controlling the CPU 21, the display panel 22, the operation unit 23, and the print engine 30. The ROM 24 can be implemented by a rewritable flash ROM, whereby the program code stored in the ROM 24 can be updated.

The RAM 25 is used as a work memory for execution of the program code and also used to temporarily store image data to be print-output by the print engine 30. The nonvolatile memory 26 is implemented by a hard disk (HDD), a flash ROM, or the like, and stores image data.

The Ethernet (registered trademark) interface 27 provides an interface for connection with the LAN 80 for transmission and reception of print data or the like. The interface 28 provides an interface for communication with the print engine 30.

The CPU 31 controls the print engine 30. The ROM 34 stores a program code for controlling the CPU 31 and the engine mechanism unit 40. The ROM 34 can be implemented by a rewritable flash ROM, whereby the program code stored in the ROM 34 can be updated.

The RAM 35 is used as a work memory for execution of the program code. The nonvolatile memory 36 stores, e.g., data for management of the number of discharged sheets. The interface 38 provides an interface for communication with the controller 20.

The engine mechanism unit 40 is used to print output image data. The cartridge 50 is comprised of a developing device, a photosensitive member, and a toner (recording agent) container, and connected to the engine mechanism unit 40. The nonvolatile memory 60 is mounted to the cartridge 50, and stores information of toner remaining amount in the cartridge 50, a serial number for individual recognition of the cartridge 50, and the like.

In this embodiment, a case where the printer 10 is used is described. However, the printing apparatus of this invention is not limited to the printer 10, but may be a multi-function peripheral having functions of copying machine, scanner, facsimile machine, printer, etc.

In this embodiment, the engine mechanism unit 40 of the printer 10 is of a laser beam printing type where toner is used as the recording agent. Alternatively, e.g., an inkjet print type engine mechanism unit may be adopted where ink is used as the recording agent.

Figure 2:
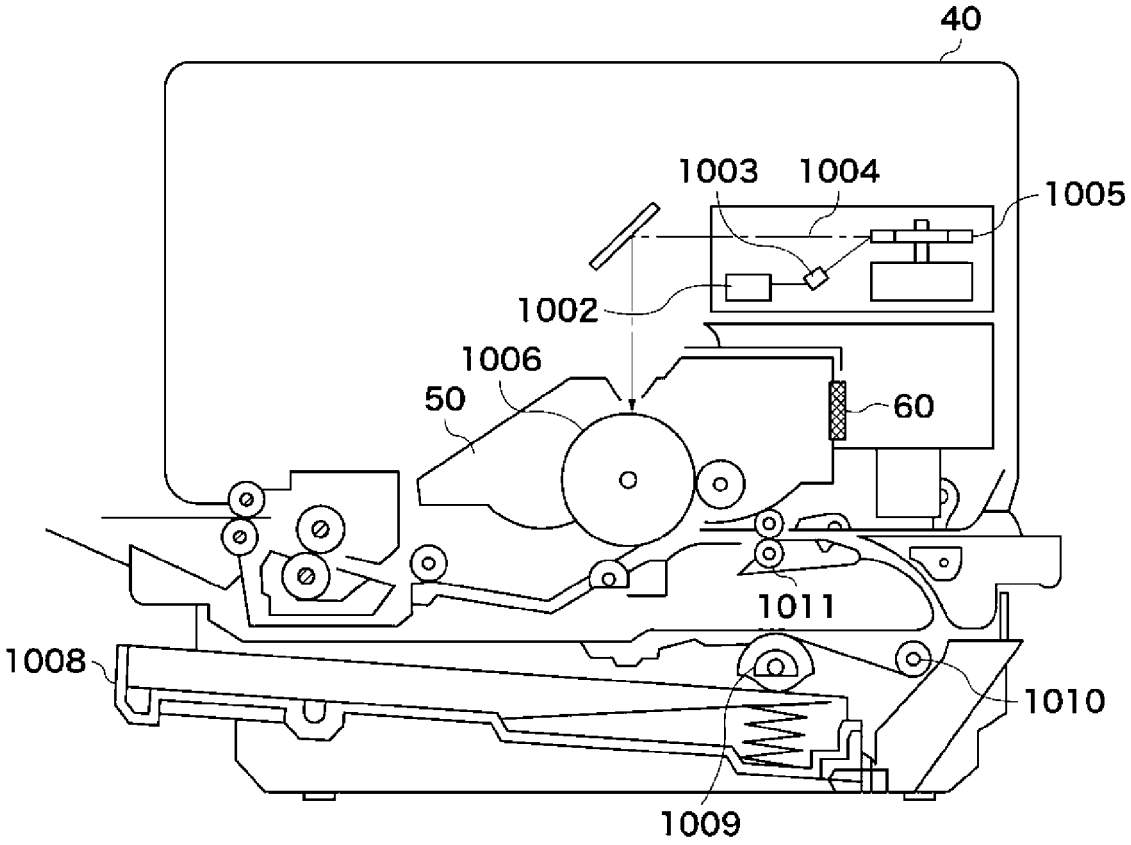
FIG. 2 is a section view showing the construction of an engine mechanism unit 40 shown in FIG. 1.

FIG. 2 shows in cross section the construction of the engine mechanism unit 40 in FIG. 1.

As shown in FIG. 2, the engine mechanism unit 40 includes a laser driver 1002, a semiconductor laser 1003, a rotary polygon mirror 1005, a printing sheet cassette 1008, a sheet feed roller 1009, and conveyance rollers 1010, 1011 as well as the cartridge 50 that includes the photosensitive member (electrostatic drum) shown at 1006, the toner container (not shown), and the nonvolatile memory 60.

Print image data is converted into a video signal, which is then output to the laser driver 1002. The laser driver 1002 is a circuit for driving the semiconductor laser 1003, and according to the input video signal, turns on and off laser light 1004 emitted from the semiconductor laser 1003.

The laser light 1004 is swung in a left-right direction by the rotary polygon mirror 1005, and scans and exposes the photosensitive member 1006, whereby an electrostatic latent image is formed on the photosensitive member 1006. The electrostatic latent image is developed by toner in the toner container (not shown) and then transferred onto a printing sheet.

Printing sheets are stored in the printing sheet cassette 1008 mounted to the print engine main body, and fed one by one into the printer by the sheet feed roller 1009 and the conveyance rollers 1010, 1011 and supplied to the photosensitive member 1006.

The printer of this invention is not limited to the laser beam printer, but may be an inkjet printer, a dye sublimation printer, a silver halide printer, or the like.

Figure 3:
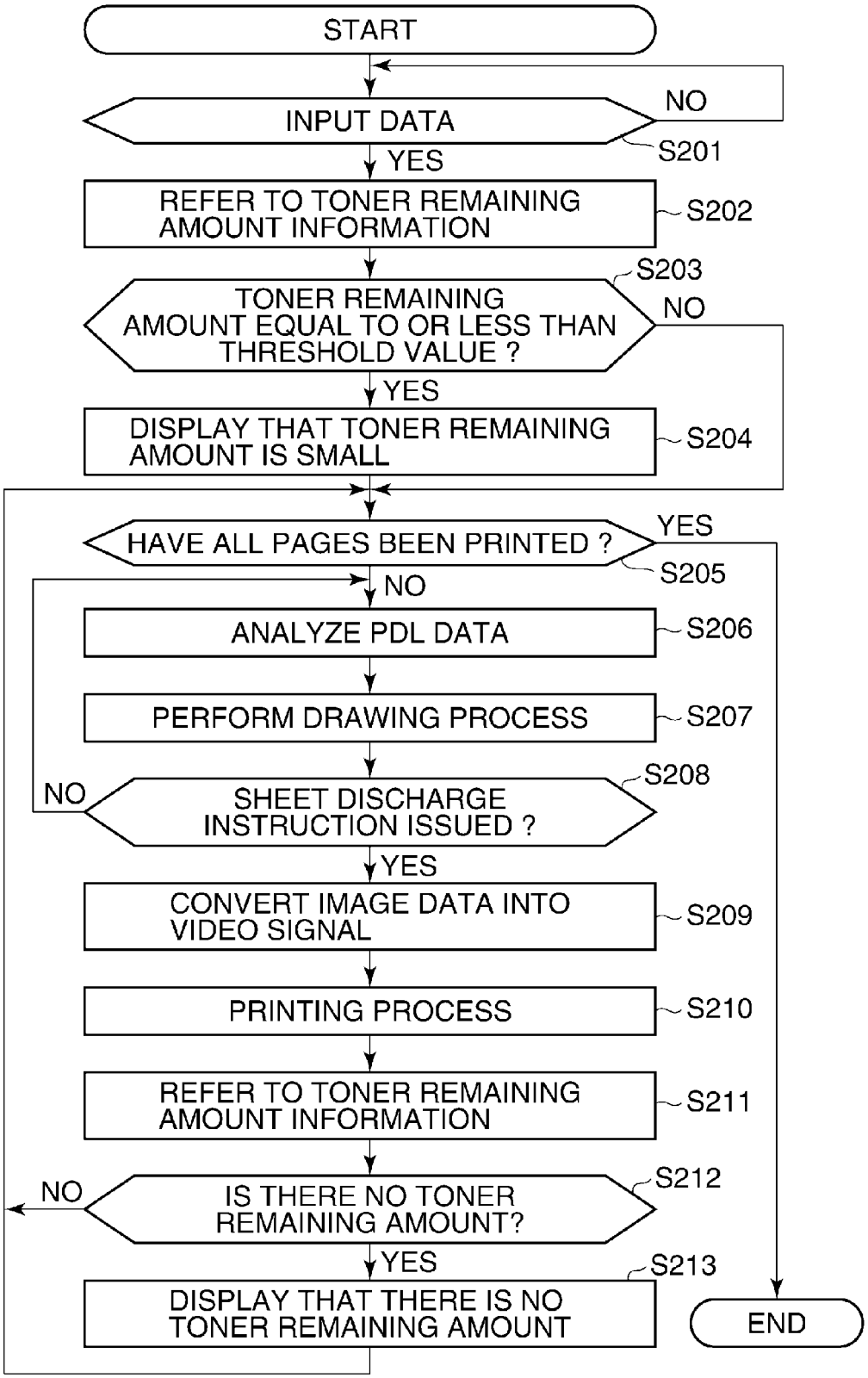
FIG. 3 is a flowchart of a process executed by the printer 10.

FIG. 3 is a flowchart showing a process performed by the printer 10.

In FIG. 3, the printer 10 receives PDL (page description language) data transmitted from the PC 70, and performs a printing process.

When inputting (receiving) the PDL data from the PC 70 via the Ethernet (registered trademark) interface 27 (YES to step S201), the CPU 21 accesses the nonvolatile memory 60 of the cartridge 50 and refers to toner remaining amount information (step S202).

Next, the CPU 21 determines whether the toner remaining amount in the cartridge 50 is equal to or less than a threshold value (step S203). If it is determined in step S203 that the toner remaining amount exceeds the threshold value, the flow proceeds to step S205. On the other hand, if it is determined in step S203 that the toner remaining amount is equal to or less than the threshold value, the CPU 21 causes the display panel 22 to display that the toner remaining amount is small (step S204), and proceeds to step S205.

In step S205, the CPU 21 determines whether all the pages of the received PDL data have been printed. If it is determined in step S205 that all the pages of the received PDL data have been printed, the process is completed. On the other hand, if it is determined in step S205 that all the pages of the received PDL data have not been printed, the flow proceeds to step S206.

In step S206, the CPU 21 analyzes PDL data. Then, the CPU 21 performs an image data creation process (drawing process) according to instructions described in the PDL data (step S207).

Next, the CPU 21 determines whether a sheet discharge instruction is issued (step S208). If it is determined in step S208 that a sheet discharge instruction is not issued, the flow returns to step S206. On the other hand, if it is determined in step S208 that a sheet discharge instruction is issued, the flow proceeds to step S209.

In step S209, the CPU 21 converts image data created on the RAM 25 into a video signal and transfers the video signal to the print engine 30 via the interfaces 28 and 38 (step S209). Next, the print engine 30 is caused to perform a printing process in FIG. 4 (described later) and discharge a sheet on which the image has been printed (step S210).

After completion of the printing process in step S210, the CPU 21 accesses the nonvolatile memory 60 of the cartridge 50 to refer to the toner remaining amount information (step S211), and determines whether there is no toner remaining amount in the cartridge 50 (step S212). It should be noted that in this invention a state where there is no toner remaining amount does not indicate that toner is entirely exhausted, but indicates that toner is exhausted to an extent where proper printing quality cannot be realized (e.g., faint or blurred printing can be caused) when printing is performed in the toner exhausted state. In other words, in this invention, printing can be continued even if it is determined that there is no toner remaining amount. In this specification, a state where there is a toner remaining amount does not indicate that there is a slight amount toner, but indicates that there is sufficient toner to an extent where proper printing quality can be realized (e.g., faint or blurred printing can be prevented) when printing is performed in the toner remaining state. Thus, in this invention, a state where there is no toner remaining amount means that the toner remaining amount is less than a predetermined value, and a state where there is a toner remaining amount means that the toner remaining amount is greater than the predetermined value, which is larger than zero but less than the threshold value in S203. If it is determined in step S212 that there is a toner remaining amount in the cartridge 50, the flow returns to step S205.

If it is determined in step S212 that there is no toner remaining amount in the cartridge 50, the CPU 21 causes the display panel 22 to display a notification that there is no toner remaining amount (step S213), and proceeds to S205. In that case, it is possible to stop printing halfway (the cartridge 50 can be replaced at that time) and restart printing if a printing restart instruction is given by a user.

Processing in steps S201 to S209 and steps S211 to S213 is for creating image data and performed by a module of the controller 20.

Figure 4:
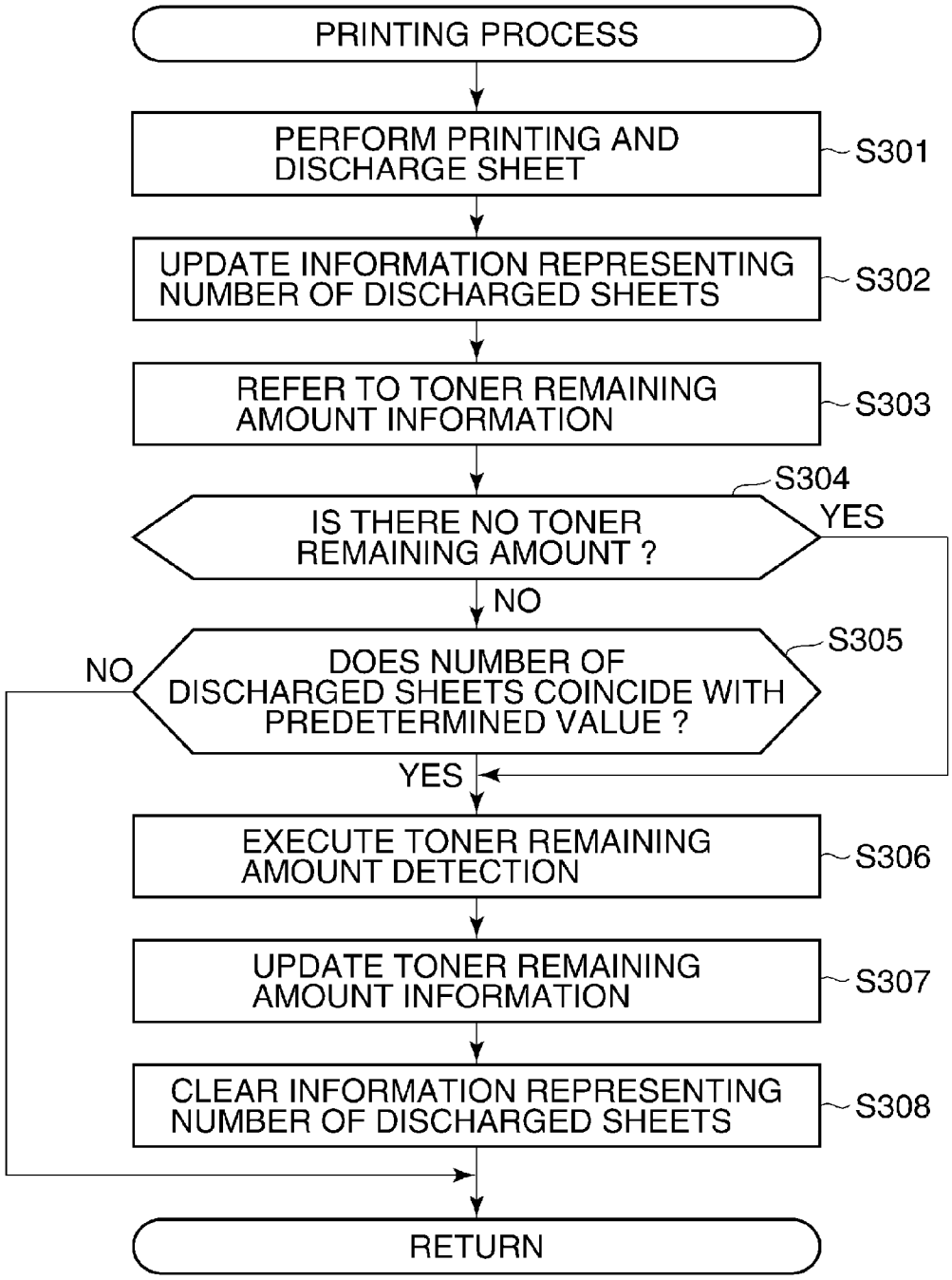
FIG. 4 is a flowchart showing the details of a printing process in step S210 in FIG. 3.

FIG. 4 is a flowchart showing the details of the printing process in step S210 in FIG. 3.

As shown in FIG. 4, the CPU 31 causes the image to be printed on a sheet according to the video signal created in step S209 in FIG. 3, and causes the sheet to be discharged (step S301). Next, the CPU 31 updates information representing the number of discharged sheets and stores the information into the nonvolatile memory 36 of the print engine 30 (step S302).

Next, the CPU 31 accesses the nonvolatile memory 60 of the cartridge 50 to refer to toner remaining amount information (step S303), and determines whether there is no toner remaining amount in the cartridge 50 (step S304). It should be noted that in this invention, a state where there is no toner remaining amount does not indicate that toner is entirely exhausted, but indicates that toner is exhausted to an extent where proper printing quality cannot be realized (e.g., faint or blurred printing can be caused) when printing is performed in the toner exhausted state. In other words, in this invention, printing can be continued even if it is determined that there is no toner remaining amount. In this invention, a state where there is a toner remaining amount does not indicate that there is a slight amount toner, but indicates that there is sufficient toner to an extent where proper printing quality can be realized (e.g., faint or blurred printing can be prevented) when printing is performed in the toner remaining state. Thus, in this invention, a state where there is no toner remaining amount means that the toner remaining amount is less than a predetermined value, and a state where there is a toner remaining amount means that the toner remaining amount is greater than the predetermined value, which is larger than zero but less than the threshold value in S203.

If it is determined in step S304 that there is no toner remaining amount in the cartridge 50, the flow proceeds to step S306. On the other hand, if it is determined in step S304 that there is a toner remaining amount in the cartridge 50, the flow proceeds to step S305.

In step S305, the CPU 31 determines whether the number of discharged sheets represented by information stored in the nonvolatile memory 36 coincides with a predetermined value. The predetermined value can be set to an arbitrary number of discharged sheets based on a time period required for execution of toner remaining amount detection and degrees of consumption of the developing device, photosensitive member, and toner per each execution of the remaining amount detection.

If it is determined in step S305 that the number of discharged sheets represented by the information stored in the memory 36 does not coincide with the predetermined value, the process returns to step S301. On the other hand, if it is determined in step S305 that the number of discharged sheets coincides with the predetermined value, the flow proceeds to step S306.

In step S306, the CPU 31 executes the toner remaining amount detection. Next, the CPU 31 updates the toner remaining amount information stored in the nonvolatile memory 60 of the cartridge 50 (step S307), and clears the information representing the number of discharged sheets, which is stored in the nonvolatile memory 36 of the print engine 30 (step S308).

Figure 5A:
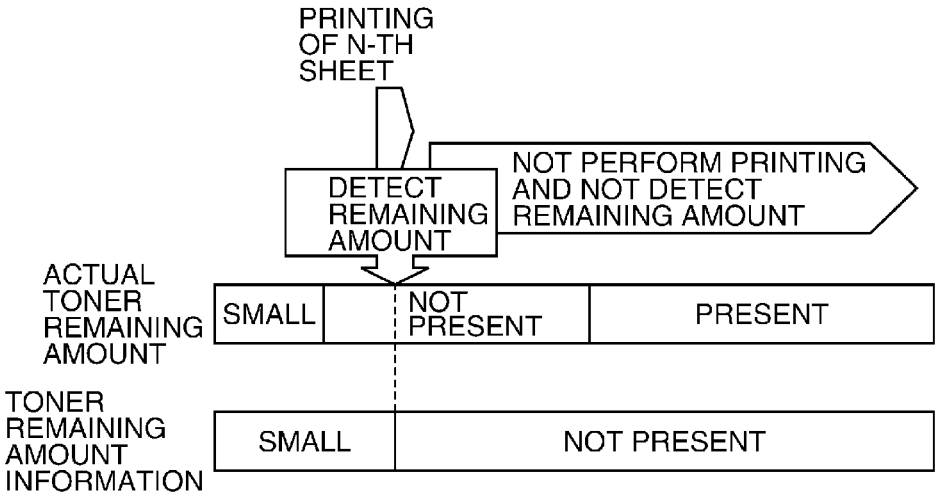
FIG.5A PRIOR ART
FIG. 5A is a view for explaining a change in toner remaining amount information according to the prior art.
Figure 5B:
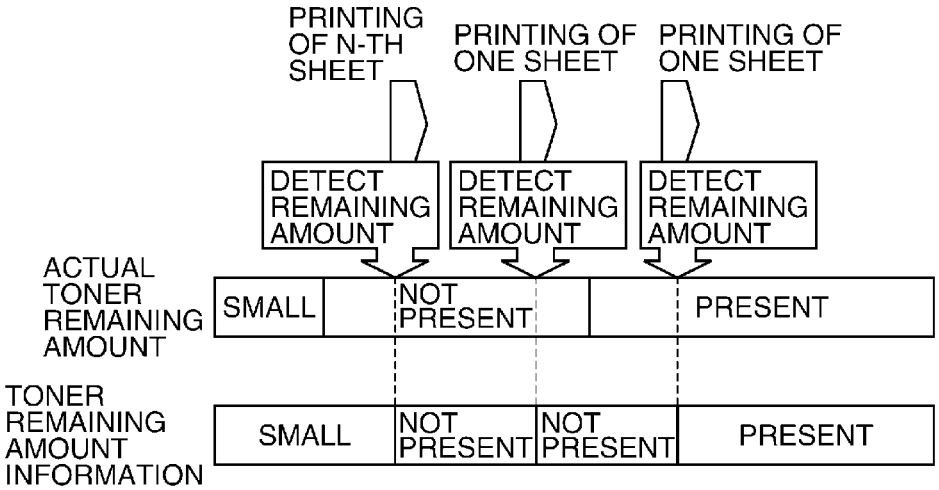
FIG. 5B is a view for explaining a change in toner remaining amount information according to this invention.

FIG. 5A illustrates a change in toner remaining amount information according to the prior art. FIG. 5B illustrates a change in toner remaining amount information according to this invention.

As shown in FIG. 5A, according to the prior art, if it is determined in toner remaining amount detection performed at the time of printing a predetermined N-th sheet (e.g., ninetieth sheet) that there is no toner remaining amount, information indicating to that effect is stored in a nonvolatile memory of a cartridge. In that case, no further printing and no further toner remaining amount detection are carried out. Accordingly, the toner remaining amount information cannot be updated even after toner is replenished to the cartridge.

As shown in FIG. 5B, according to this invention, the toner remaining amount detection is executed each time printing of one sheet has been performed or attempted even after it is determined in toner remaining amount detection performed at the time of printing a predetermined N-th sheet (e.g., ninetieth sheet) that there is no toner remaining amount. It is therefore possible to update the toner remaining amount information stored in the nonvolatile memory 60 of the cartridge 50 so as to coincide with an actual toner remaining amount. When toner is replenished to the cartridge 50 after it is determined that there is no toner remaining amount, the toner replenishment is detected and the toner remaining amount information is updated.

According to the first embodiment, if it is determined in the toner remaining amount detection that there is no sufficient toner remaining amount, the frequency of execution of the toner remaining amount detection is increased such that the detection is executed each time printing of one sheet has been performed or attempted. Then, the toner remaining amount information stored in the memory of the cartridge is updated after the detection of toner remaining amount. If it is determined that there is a sufficient toner remaining amount, the frequency of execution of toner remaining amount detection is decreased or returned to a predetermined frequency. It is therefore possible to reduce the frequency of execution of the recording agent remaining amount detection and obtain accurate information of the recording agent remaining amount.

(Second Embodiment)

In the following, a second embodiment of this invention is described.

In the first embodiment, an example has been described in which the toner remaining amount detection is executed at a timing where image data for every predetermined number of sheets has been printed or at a timing where printing of one sheet has been executed or attempted. In the second embodiment, in a case where it is determined that there is no sufficient toner remaining amount, the toner remaining amount detection is also executed at predetermined timings (e.g., at start-up of the printer, at replacement of the cartridge, at the time of a print job being input by the printer, and at the time of a shift from a power-saving mode to a normal power mode).

The ability to execute the toner remaining amount detection when the cartridge is replaced is advantageous in that the toner remaining amount detection can be executed immediately after toner is replenished to the cartridge 50. The replacement of cartridge can be detected by a sensor (not shown) by detecting that the cartridge 50 is removed from the print engine 30 and then a new cartridge 50 is inserted into the cartridge 50.

The ability to execute the toner remaining amount detection when the printer inputs a print job is advantageous in that it is possible to prevent only a first sheet from being discharged when there is no toner remaining amount. It should be noted that in this case it is assumed that the print engine 30 performs printing based on the print job.

The ability to execute the toner remaining amount detection when a shift is made from a power-saving mode to a normal power mode is advantageous in that the toner remaining amount detection can be executed immediately after toner is replenished to the cartridge 50 during the power-saving state. It should be noted that in this case it is assumed that the printer 10 is operable either in the normal power mode or in the power-saving mode in which power consumption is smaller than in the normal power mode.

According to the second embodiment, in a case where it is determined that there is no sufficient toner remaining amount, the toner remaining amount detection is executed also at predetermined timings (e.g., at start-up of the printer, at replacement of the cartridge, at the time of a print job being input by the printer, and at the time of a shift from the power-saving mode to the normal power mode). It is therefore possible to reduce the frequency of execution of recording agent remaining amount detection and obtain more accurate information of recording agent remaining amount.

(Third Embodiment)

In the first embodiment, the toner remaining amount is directly detected by the CPU 31. On the other hand, in a third embodiment, the toner remaining amount is directly detected by the cartridge 50. In that case, the toner remaining amount is indirectly detected by the CPU 31.

In the third embodiment, the printer 10 performs processing that is substantially the same in content as the processing in the first embodiment shown in the flowcharts of FIGS. 3 and 4. The following is a description of parts of the third embodiment which differ from the first embodiment.

In the third embodiment, the cartridge 50 detects in advance the toner remaining amount at predetermined intervals (in terms of time or number of print sheets) and stores toner remaining amount information in the nonvolatile memory 60. In S306, the CPU 21 reads the toner remaining information from the nonvolatile memory 60, whereby the CPU 31 indirectly detects the toner remaining amount. In S307, the CPU 21 updates the toner remaining amount information stored in the nonvolatile memory 36 by using the toner remaining information amount read in S306. In S202, S211, and S303, the CPU 21 accesses the nonvolatile memory 36 to refer to the toner remaining amount information.

(Other Embodiments)

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform functions of the above-described embodiments. For this purpose, the program is provided to the computer for example via network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-222322, filed Sep. 28, 2009, which is hereby incorporated by reference herein in its entirety.

What is claimed is:

1. A printing apparatus comprising:

a printing unit configured to perform printing using a recording agent;

a detection unit configured to detect a remaining amount of the recording agent at a predetermined frequency of detection; and a control unit configured to control said detection unit to increase the frequency of detection in a case where the remaining amount of the recording agent detected by said detection unit is less than a predetermined value.

2. The printing apparatus according to claim 1, further including:

a notification unit configured to notify a user that the remaining amount of the recording agent becomes less than the predetermined value in a case where the remaining amount of the recording agent detected by said detection unit becomes less than the predetermined value.

3. The printing apparatus according to claim 1, wherein said control unit controls said detection unit to detect the remaining amount of the recording agent when the printing apparatus is started up in a case where the remaining amount of the recording agent detected by said detection unit is less than the predetermined value.

4. The printing apparatus according to claim 1, wherein:

the recording agent is stored in a cartridge, and said control unit controls said detection unit to detect the remaining amount of the recording agent when the cartridge is replaced in a case where the remaining amount of the recording agent detected by said detection unit is less than the predetermined value.

5. A printing apparatus comprising:

a printing unit configured to perform printing using a recording agent;

a detection unit configured to detect a remaining amount of the recording agent; and a control unit configured to control said detection unit to detect the remaining amount of the recording agent each time a first number of pages has been printed by said printing unit in a case where the remaining amount of the recording agent detected by said detection unit is greater than a predetermined value, and configured to control said detection unit to detect the remaining amount of the recording agent each time a second number of pages less than the first number of pages has been printed by said printing unit in a case where the remaining amount of the recording agent detected by said detection unit is less than the predetermined value, wherein the first number of pages is equal to or greater than two, and the second number of pages is equal to one.

6. A printing apparatus comprising:

a printing unit configured to perform printing using a recording agent;

a detection unit configured to detect a remaining amount of the recording agent; and a control unit configured to control said detection unit to detect the remaining amount of the recording agent each time a first number of pages has been printed by said printing unit in a case where the remaining amount of the recording agent detected by said detection unit is greater than a predetermined value, and configured to control said detection unit to detect the remaining amount of the recording agent each time a second number of pages less than the first number of pages has been printed by said printing unit in a case where the remaining amount of the recording agent detected by said detection unit is less than the predetermined value, wherein said printing unit performs printing based on a print job, and wherein said control unit controls said detection unit to detect the remaining amount of the recording agent when said printing unit inputs a print job in a case where the remaining amount of the recording agent detected by said detection unit is less than the predetermined value.

7. A printing apparatus comprising:

a printing unit configured to perform printing using a recording agent;

a detection unit configured to detect a remaining amount of the recording agent; and a control unit configured to control said detection unit to detect the remaining amount of the recording agent each time a first number of pages has been printed by said printing unit in a case where the remaining amount of the recording agent detected by said detection unit is greater than a predetermined value, and configured to control said detection unit to detect the remaining amount of the recording agent each time a second number of pages less than the first number of pages has been printed by said printing unit in a case where the remaining amount of the recording agent detected by said detection unit is less than the predetermined value, wherein the printing apparatus is operable either in a normal power mode or in a power-saving mode in which power consumption is smaller than in the normal power mode, and wherein said control unit controls said detection unit to detect the remaining amount of the recording agent when a shift is made from the power-saving mode to the normal power mode in a case where the remaining amount of the recording agent detected by said detection unit is less than the predetermined value.

8. A control method for a printing apparatus having a printing unit that performs printing using a recording agent and a detection unit that detects a remaining amount of the recording agent, the method comprising the steps of:

controlling the detection unit to detect the remaining amount of the recording agent at a predetermined frequency of detection; and controlling the detection unit to increase the frequency of detection in a case where the remaining amount of the recording agent detected by the detection unit is less than a predetermined value.

9. A non-transitory computer-readable storage medium storing a program for causing a computer to execute a control method for a printing apparatus having a printing unit that performs printing using a recording agent and a detection unit that detects a remaining amount of the recording agent, the method comprising the steps of:

controlling the detection unit to detect the remaining amount of the recording agent at a predetermined frequency of detection; and controlling the detection unit to increase the frequency of detection in a case where the remaining amount of the recording agent detected by the detection unit is less than a predetermined value.

* * * * *